US005452475A

United States Patent [19]

Hunt

[11] Patent Number: 5,452,475

[45] Date of Patent: Sep. 26, 1995

[54] BASEBALL CATCHER'S LEG GUARD

[75] Inventor: Wilson F. Hunt, Jr., Glenview, Ill.

[73] Assignee: Wilson Hunt International Ltd., Glenview, Ill.

[21] Appl. No.: 127,292

[22] Filed: Sep. 27, 1993

[51] Int. Cl.[6] ..... A41D 13/00

[52] U.S. Cl. ..... 2/22

[58] Field of Search ..... 2/16, 22, 23, 24, 2/2, 62, 45; 602/16, 20, 23, 26

[56] References Cited

U.S. PATENT DOCUMENTS

| | | | |
|---|---|---|---|
| D. 297,178 | 8/1988 | Jurga | 2/22 X |
| 3,735,419 | 5/1973 | Byrd | 2/22 |
| 4,627,108 | 12/1986 | Järvinen | 2/22 |
| 4,692,946 | 9/1987 | Jurga | 2/22 |
| 4,876,745 | 10/1989 | Richards | 2/24 |
| 4,888,826 | 12/1989 | Parsons, Jr. et al. | 2/22 |
| 5,107,823 | 4/1992 | Fratesi | 2/22 X |
| 5,172,425 | 12/1992 | Smith | 2/22 |

FOREIGN PATENT DOCUMENTS

| | | | |
|---|---|---|---|
| 3626005 | 2/1988 | Germany | 2/24 |

*Primary Examiner*—Clifford D. Crowder
*Assistant Examiner*—Paul C. Lewis
*Attorney, Agent, or Firm*—Hill, Steadman & Simpson

[57] ABSTRACT

A leg guard for a baseball catcher has a thigh portion of a rigid shell with a pad affixed thereto that is connected by a pair of straps to a knee portion of a rigid shell with a pad affixed thereto. The same pair of straps connect to a shin portion, which also has a rigid shell and a pad affixed thereto. The pad of the shin portion has an extension at an upper end that is attached thereto by a narrow neck and that extends to behind the knee portion. The extension of the shin pad is cup shaped to cup the knee of the wearer and thereby provide a second layer of padding at the knee. The knee portion floats relatively to the thigh and shin portions during bending of the leg, while still keeping all parts of the knee area covered by a rigid shell.

14 Claims, 2 Drawing Sheets

FIG. 1
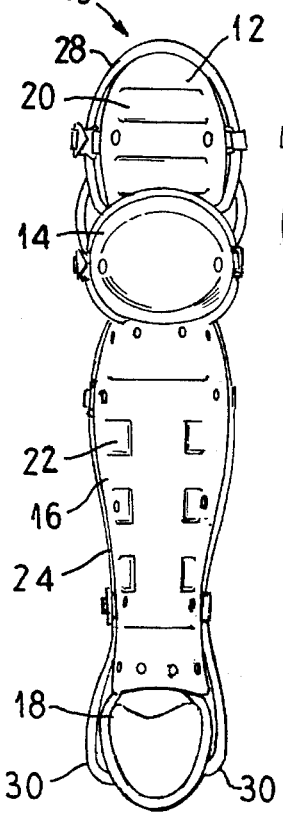
FIG. 2
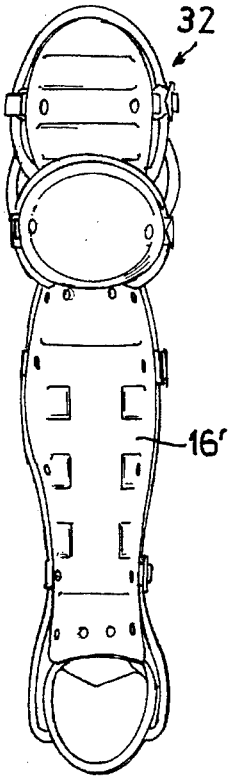
FIG. 3
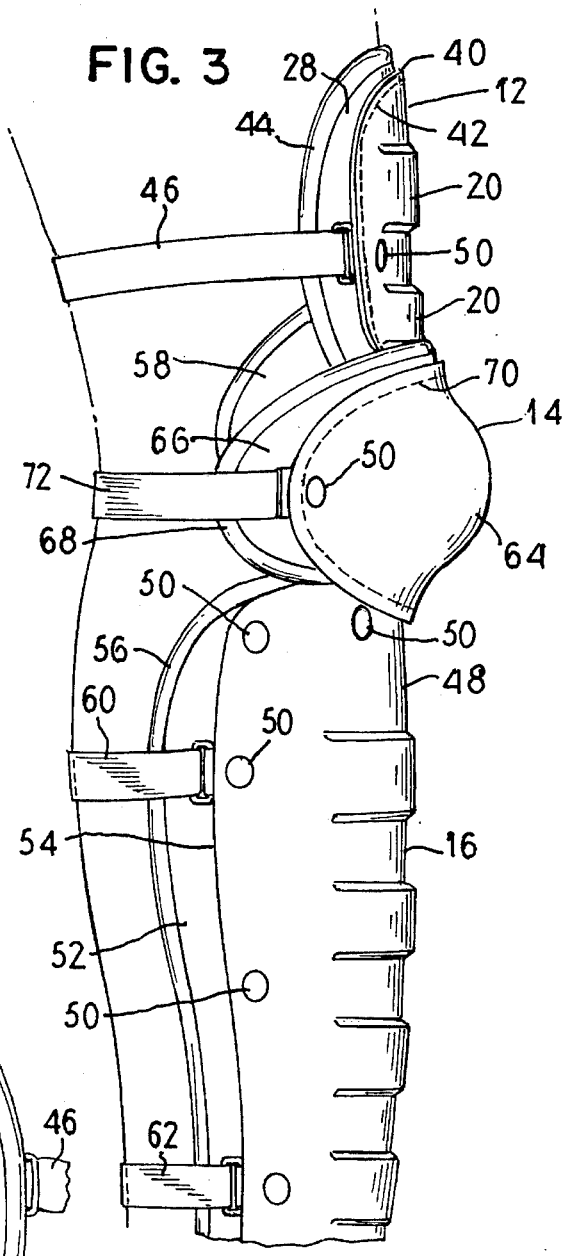
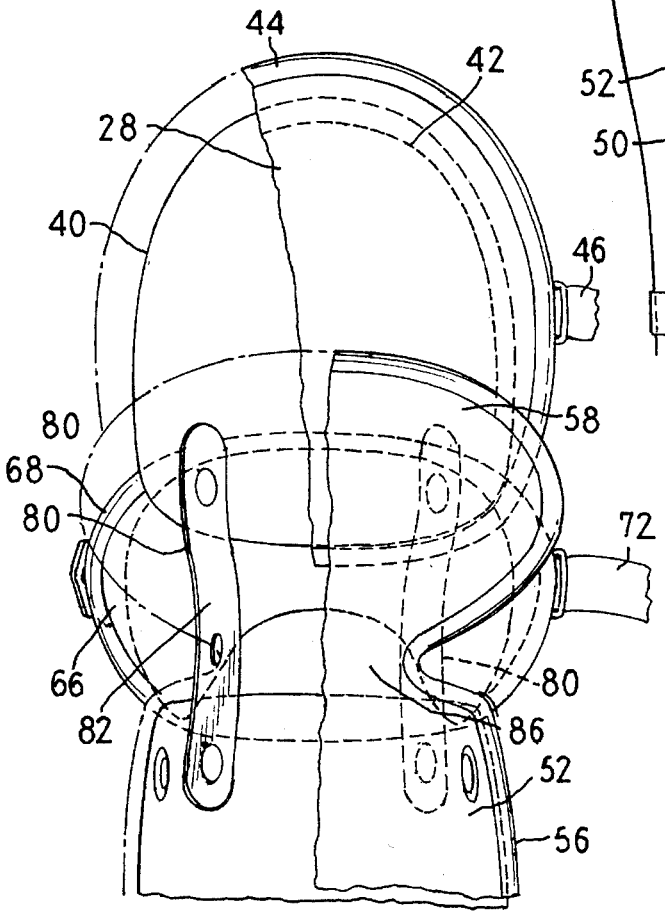
FIG. 7

BASEBALL CATCHER'S LEG GUARD

BACKGROUND OF THE INVENTION

1. Field of the Invention

The present invention relates generally to a protective leg guard, and in particular to a protective guard for shielding the interior and lateral surfaces of the leg from the top of the foot to mid thigh of the type generally used by baseball catchers.

2. Description of the Related Art

The use of leg guards by baseball catchers is well known, wherein the anterior and lateral portions of the legs of the catcher are to be protected from thrown or batted balls, from bats, and from other players approaching home plate while the catcher is standing, squatting or kneeling. Flexibility and comfort as well as adequate protection is important so as not to interfere with the catcher's playing performance.

Many knee and shin guards expose a portion of the knee and/or upper shin when the catcher's knee is bent between the hard shield portions of the guard. While the exposed region may still be covered by padding, this can prove inadequate when this area is struck by a thrown or batted ball, or by the spikes of a player sliding into home plate.

U.S. Pat. Nos. 4,692,946 and Des. 297,178 disclose a baseball catcher's leg guard.

SUMMARY OF THE INVENTION

It is an object of the present invention to provide a leg guard of the type worn by baseball catchers which keeps the knee and upper shin area covered with a hard protective shield even when the catcher's knee is fully bent.

An object is to provide improved protection for the knee and upper shin area by a shin guard.

It is another object of the present invention to provide a leg guard having a flexible knee region so as not to hinder mobility of the wearer.

Yet another object of the present invention is to provide a leg guard which is comfortable to wear, reduces binding at the knee fitting and is easily donned and removed.

These and other objects and advantages of the present invention are achieved in a catcher's leg guard having a main body comprising a rigid outer shell generally in the shape of the interior and lateral surfaces of the shin and reinforced with a central vertical rib on the interior surface thereof and reinforcing ribs extending laterally therefrom. The rearward inside surface of the rigid shin piece is lined with a soft foam or rubber pad having an outer plastic skin and an inner fabric skin and bound at the peripheral edges thereof with fabric binding tape. The lining is affixed to the shin piece by a plurality of rivets generally adjacent the peripheral edges of the shin piece. Preferably, the lining extends beyond the rigid shin piece shell to provide additional protection for the lateral surfaces of the shin and calf. Extending from the lower, distal end of the shin guard are a pair of opposed extension ears or flaps of the shin lining pad which act as ankle bone protection pads for either side of the ankles. The lower distal end of the rigid shin guard is cut along a somewhat upwardly curving path in the direction of the interior surface of the shin guard to provide clearance for the top of the foot. A separate flap of the soft foam or rubber pad material extends between the shin guard and the shin guard pad at the lower distal end thereof and is riveted in place. The flap spreads to an increased width beyond the lower end of the shin guard and then curves about a somewhat semicircular or semi-ovular shape. A portion of the interior surface of the flap is covered by a rigid plastic foot guard, preferably also having reinforcing ribs.

The top, proximal end of the shin guard is smooth and free of the reinforcing ribs. Overlapping the top, proximal edge of the shin guard is a rigid knee guard extending on the interior and lateral surfaces of the knee. Extending above and proximal to the knee guard is a rigid thigh guard having a generally partially cylindrical shape with reinforcing ribs formed thereon. The rigid thigh guard defines an approximately oval peripheral outline and affixed to an inner surface thereof is a soft foam or rubber pad having an extent somewhat greater than the rigid thigh guard. The pad is affixed to the rigid thigh guard by sewing about the top and lateral edges thereof while leaving the pad free of the rigid shin guard at the lower, distal end thereof.

The knee guard, the shin guard and the thigh guard are connected to one another by a pair of straps disposed on either side of the medial surface of the shin guard in generally parallel relation to one another. The straps are fastened at a lower end between the rigid shin guard and the shin pad by respective rivets through the shin guard and the strap. The strap extends upward and is free for a distance of approximately two inches before being sewn to a pad lining the knee guard. The straps are not affixed to the knee guard itself, however. The upper end of each strap is riveted to the thigh guard and extends between the thigh guard and the thigh pad at the lower end of the thigh guard where the thigh guard pad is free of the thigh guard. The pad lining the knee guard is affixed to the knee guard by sewing at the peripheral top and lateral edges thereof while being free at the lower edge. The combination of the pair of straps having free flexing sections between the knee guard pad and the shin guard enables the knee guard to float freely over the knee while remaining in overlapped position over the shin guard in all relative positions thereof.

The shin guard pad includes a knee pad cup portion extending from an upper proximal end of the shin guard and connected thereto by a narrow pad portion. The knee pad cup lies at the inside surface of the knee guard and knee guard pad as well as at the inside surface of the thigh guard and thigh guard pad while remaining unconnected thereto. The knee pad cup is generally in the shape of an oval having an elongated axis in a horizontal direction and is formed in two pieces with a seam in a horizontal direction so as to provide a cup shaped pad encasing the interior and lateral surfaces of the knee area beneath the knee guard and the lower end of the thigh guard.

A plurality of elastic web straps extend from the lateral peripheral surfaces of the present leg guard to encircle the rear surface of the leg and hold the leg guard in place. In particular, a web loop with a pair of metal rings is riveted in place at one peripheral lateral edge of the leg guard while a web loop having a female portion of a snap fastener is riveted at a corresponding peripheral location on the opposing lateral edge of the leg guard. The elastic web strap is threaded through the two metal loops so as to form an adjustable connection and a free end of the elastic web strap is connected to a male snap connector which selectively connects to the female snap connector at the opposing lateral peripheral edge of the leg guard. In a preferred embodiment, two such elastic web straps are provided for the shin guard portion, a third elastic web strap is provided for the knee guard portion, while a fourth such elastic web strap is provided for the thigh guard portion.

BRIEF DESCRIPTION OF THE DRAWINGS

The invention shall be set forth in greater detail below with reference to the drawings.

FIG. 1 is a front view of a right catcher's leg guard according to the principles of the present invention;

FIG. 2 is a front view of a left catcher's leg guard of the invention;

FIG. 3 is a side view of the catcher's leg guard of FIG. 1 or FIG. 2 shown worn on a leg;

FIG. 7 is a elevational rear view, partially broken away, of the leg guard showing the padding arrangement and the straps connecting the various parts.

DETAILED DESCRIPTION OF THE PREFERRED EMBODIMENTS

Figure 4:
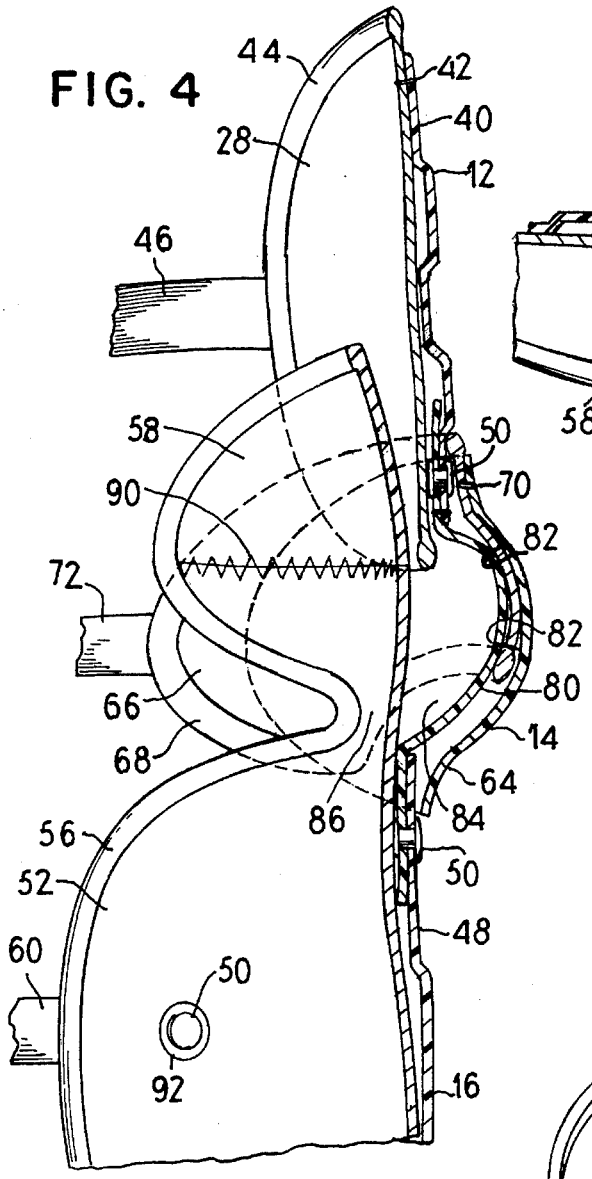
FIG. 4 is vertical cross section of the leg guard of FIG. 3 to show the padding.

In FIG. 1 is shown a leg guard 10 of the type for wear a baseball catcher to shield the catcher's shin, knee, thigh, and foot from being struck by a ball, or possibly by a bat, or by a player running toward home plate. The leg guard 10 includes a thigh portion 12, a knee portion 14, a shin portion 16 and a foot portion 18. Each of the portions 12–18 include a rigid outer shell on the front, or outer, surface and a pliable foam rubber pad on the rear, or inner, surface. The rigid shell of the thigh portion 12 is generally oval in shape and has laterally extending ribs 20 for reinforcement purposes. The rigid shell of the shin portion 16 has a vertically extending center rib 22 with several laterally extending ribs 24 extending therefrom. The foot portion likewise has reinforcing ribs 26. The foam rubber pad, denoted 28, which here is a dense foam rubber sheet having a fabric covered inner surface and a rubberized or vinyl covered outer surface, extends beyond the edges of the rigid shells. Two flaps 30 of the foam rubber pad extend downward from the shin portion 16 to either side of the foot portion to protect the ankles of the catcher.

The leg guard 10 shown in FIG. 1 is for wear on the right leg of the catcher, while a leg guard 32 for wear on the left leg of the catcher is shown in FIG. 2. FIGS. 1 and 2, thus, show a pair of the leg guards. As may be seen by comparing the leg guards 10 and 32 of FIGS. 1 and 2, the guards are shaped to conform to the shapes of the respective legs on which they are to be worn. In particular, the configuration of the shin guard portion 16 of FIG. 1 compared with the corresponding shin portion 16 of the leg guard of FIG. 2 shows that the rigid shell is shaped to the musculature of the calves and shins of the respective legs.

Referring to FIG. 3, the thigh portion 12 has a rigid portion 40 curved to fit the thigh and a pad 28 extending beyond the edges of the rigid portion 40 and affixed thereto by stitching 42. The stitching extends along the top and two sides of the thigh portion 12, but not along the bottom, as will be discussed hereinafter. The outer edges of the pad 28 are covered by an edging 44 to prevent fraying and wear.

Figure 8:
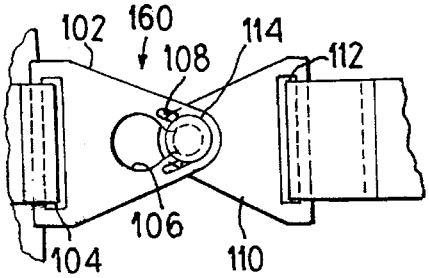
FIG. 8 is a plan view of a buckle for use on an exemplary embodiment of the present invention.

A strap 46 extends about the thigh of the wearer to hold the thigh portion 12 in place. The strap 46 is somewhat elastic in the preferred embodiment. Although many different attachment means are possible for attaching the strap 46 to the thigh portion 12, an exemplary embodiment has a pair of "D" rings though which the strap 46 is looped to form a cinch for adjustably securing one end of the strap 46 to the thigh portion 12. The D rings are held in a short loop of webbing that is fastened to the thigh portion by a rivet 50. The other end of the strap 46 is removably fastened at the other side of the thigh portion 12 by a buckle. An example of a buckle is shown in FIG. 8, as will be discussed hereinafter.

On the lower portion of the leg shown in FIG. 3 is the shin portion 16. It also has a rigid shell 48 shaped to the contour of the front and sides of the shin, and as shown in FIGS. 1 and 2, the contours for the left and right shin portions 16 and 16 differ in a symmetrical way to accommodate the symmetrical contours of the calf muscles. Attached to the rigid shell 48 by rivets 50 is a pad 52 of the same dense form sheet used for the thigh portion 12. The rivets 50 provide a greater durability in holding the pad 52 to the rigid shell 48. The pad 52 of the preferred embodiment also extends further beyond lateral edges 54 of the rigid shell 48 than for the thigh portion 12. The pad 52 has edging 56 like the thigh pad 28.

An inner knee pad 58 which can be seen behind the knee portion 14 and behind the lower part of the thigh portion 12 is connected to the pad 52 of the shin portion 16 and extends upward above the upper edge of the rigid shell 48. The inner knee pad 58 is shaped to cup the knee of the wearer. In particular, it is formed from two pieces, wherein a convexly curved edge of one piece is sewn to a convexly curved edge of the other piece to form a seam along a horizontal midline of the inner knee pad 58 thereby providing a first of two layers of padding at the knee joint. When the knee is straight, as shown in FIG. 3, the inner knee pad 58 extends upward to behind the thigh portion 12. As will be seen in subsequent figures, the thigh portion 12 and the knee portion 14 are free to move to other positions relative to the inner knee pad 58 as the knee joint is bent and unbent. This provides an increased level of comfort and flexibility to the wearer.

Like the thigh portion 12, the shin portion 16 is also held to the leg of the wearer by straps 60 and 62. The straps 60 and 62 of the preferred embodiment include the D rings and buckles as well. The straps 60 and 62 are connected to the shin portion 16 by rivets.

Between the thigh portion 12 and the shin portion 16 is the knee portion 14, which includes a rigid shell 64 and a pad 66 therebeneath. The pad 66 forms the outer knee pad and lies over the inner knee pad 58. The outer pad 66 too has an edging 68 to prevent fraying and reduce wear. The outer pad 66 is connected to the rigid shell 64 by stitching 70 that runs along the top and sides of the shell 64 but not along the bottom thereof. The knee portion 14 is held to the leg of the wearer by a strap 72, which is connected to the knee portion 14 by rivets 50.

In the vertical cross section of FIG. 4, the connection of the thigh, knee and shin portions 12, 14 and 16 may be seen more clearly. Specifically, the thigh portion 12 is connected to the shin portion 16 by a pair of straps 80, one of which is shown in FIG. 4. A lower end of the strap 80 extends between the pad 52 and the rigid shell 48 of the shin portion 16 and is connected to the rigid shell 48 of the shin portion 16. The strap 80 is not connected to the pad 52 of the shin portion 16 nor to the inner knee pad 58. The upper end of the strap 80 extends between the pad 28 and the rigid shell 40 of the thigh portion 12 and is connected to the rigid shell 40 by a rivet 50. The strap 80 can extend between the pads and shells because the pad 52 on the shin portion 16 is connected to the rigid shell 48 only by the rivets 50 along each side. The pad 28 of the thigh portion 12 is connected to the shell 40 by the stitching 42 that extends only along the top and sides, leaving the bottom free.

Between the thigh portion 12 and the shin portion 16, the strap 80 is connected to the knee portion by being sewn at stitching 82. The stitching 82 connects the strap 80 to the outer knee pad 66 but does not extend to the shell 64 of the knee portion 14. In one embodiment, the stitching 82 defines a rectangle, and so extends along the sides of the strap 80 and transversely thereacross at the connection to the outer knee pad 66. The outer knee pad 66 is connected to the shell 64 only by the stitching 70 along the top and sides and so is free elsewhere. This provides some play between the pad 66 and the shell 64 at the point of connection of the strap 80. The strap 80 also has sufficient length between connection points to provide movement between the shin portion 16 and the knee portion 14, and between the knee portion 14 and the thigh portion 12.

The pad 66 in the knee portion 14 is cut out along the lower surface at a region 84 in a generally semi-circular path. The region 84 provides clearance for movement of the knee portion 14 and shin portion 16 relative to one another during bending and unbending of the leg. The pad 52 is tapered to a narrow neck 86 where it is connected to the inner knee pad 58, thereby enabling the inner knee pad to bend with the leg. A horizontal seam 90, as mentioned above, joins the two parts from which the inner knee pad is formed. The joining of these parts gives a somewhat cup shape to the inner knee pad 58.

It is noted that the rivets 50 which extend through both the pad 52 and shell 48 of the shin portion 16 include washers 92 on the inner surface to prevent the rivet 50 from pulling through the pad 52. Where the rivets 50 pass only through the rigid shells and the straps, such as at the thigh portion 12 and the knee portion 14, there is no need for the washers.

Figure 5:
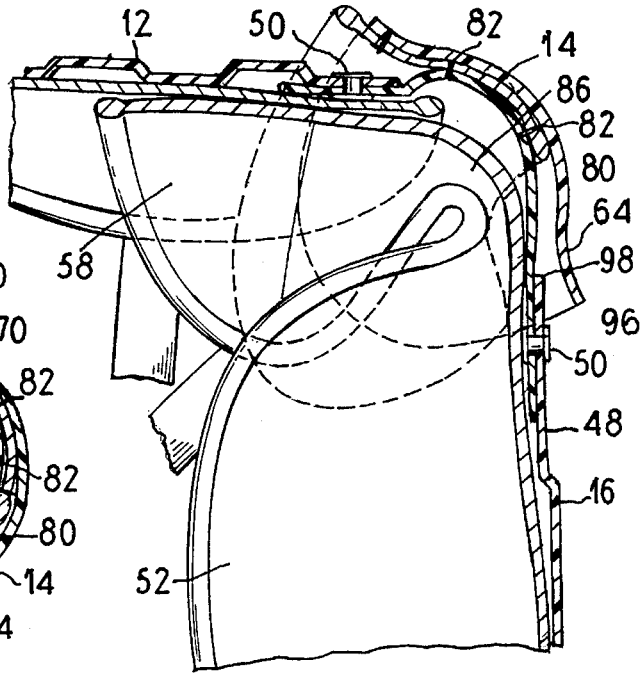
FIG. 5 is a vertical cross section of the leg guard similar to FIG. 4 but with the guard shown in the position assumed when the wearer's knee is bent.

With reference to FIG. 5, the present guard is shown in the position assumed when the wearer's leg is bent. The inner knee pad 58 bends at the neck 86 relative to the pad 52 of the'shin portion 16. The lateral edges of the inner knee pad 58 may overlap the top lateral edges of the pad 52, as shown, if the knee joint of the wearer is bent sufficiently.

The knee portion 14 essentially "floats" relative to the thigh and shin portions 12 and 16 as the leg is bent and unbent; yet, importantly, a lower edge 96 of the knee portion shell 64 never rises above an upper edge 98 of the shin portion shell 48. This means that no matter the extent of bending by the wearer's leg, the rigid shells always protect the wearer, particularly in the vulnerable area below the knee cap. This area, which in the known leg guards is exposed when the catcher is squatting or kneeling (a position frequently assumed by baseball catchers), is covered by the rigid shells of the present invention.

Figure 6:
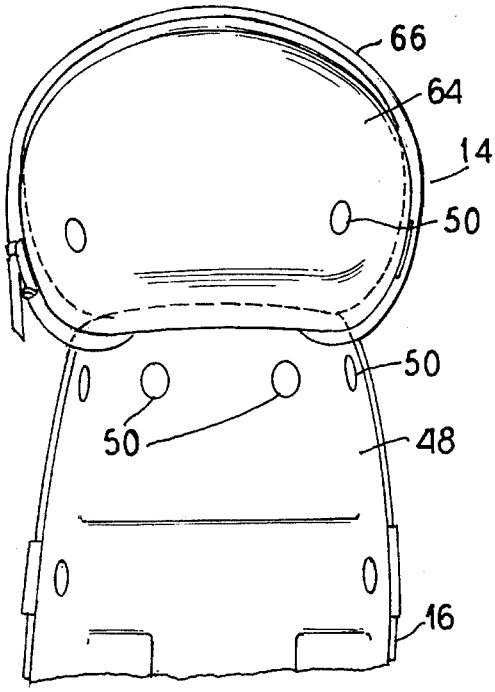
FIG. 6 is a front view of the leg guard of FIG. 5 when the wearer's knee is bent.

The extent of the protection provided by the present invention is apparent from FIG. 6, where the front view of the fully bent leg guard is shown. The rigid shell 64 of the knee portion 14 overlaps the rigid shell 48 of the shin portion 16. The two rivets 50 at the upper center of the shin portion 16 connect the two straps 80 to the shin portion 16.

The relative arrangement of the straps 80 to the other parts of the leg guard is shown in FIG. 7. The straps 80 extend from the shin portion 16, where it is connected by one of the rivets 50, to the knee portion 14, where it is connected by the rectangular arrangement of stitching 82 to the outer knee pad 66, and then to the thigh portion 12, where it is connected by another of the rivets.

The narrowing of the pad 52 of the shin portion 16 at the neck 86 where it is connected to the inner knee pad 58 is also shown in FIG. 7.

In FIG. 8, a buckle 100 is shown of the type used to connect the straps 46, 72, 60 and 62 together in a preferred embodiment. The buckle 100 has a first part 102 with a slot 104 at the wide end for receiving a loop of webbing that is affixed to the leg guard by the rivets 50. The first part 102 has a keyhole shaped opening 106 with one section thereof having a greater diameter than another section thereof. Flexible restricting members 108 are between the two opening sections.

A second part 110 also has a slot 112 through which one of the straps is looped and sewn. The other end of the second part has a button 114 with an enlarged head on a short shaft. The button 114 is inserted through the larger section of the opening 106 and moved to the smaller section of the opening. The restricting members 108 prevent free movement of the button 114 between the opening sections, the button only moving therebetween by force. Thus, the buckle 100 is snapped to a hooked position, as shown, and the strap is closed about the wearer's leg. Snapping the buckle to move the button 114 to the larger opening enables the head to pass through the opening 106 and, thereby, unfastens the strap from about the wearer's leg.

Thus, there is shown and described a leg guard for wear by, for example, a baseball catcher, the leg guard providing protection for the wearer's leg and particularly the knee area while being comfortable to wear and fully flexible.

Although other modifications and changes may be suggested by those skilled in the art, it is the intention of the inventor to embody within the patent warranted hereon all changes and modifications as reasonably and properly come within the scope of his contribution to the art.

I claim:

1. A leg guard for attachment to a leg, comprising:

a shin portion having a first rigid shell shaped to fit on an anterior surface of a shin of a leg and a first pad affixed to said first rigid shell between said first rigid shell and the leg;

at least one strap securable about the leg to hold said shin portion in place on the anterior surface of the leg;

a thigh portion having a second rigid shell shaped to fit on an anterior surface of a thigh of the leg and a second pad affixed to said second rigid shell between said second rigid shell and the leg;

a knee portion having a third rigid shell shaped to fit an anterior surface of a knee of the leg and a third pad affixed to said third rigid shell between said third rigid shell and the leg;

a connecting strap having a first end connected to said shin portion and a second end connected to said thigh portion and an intermediate region connected to an interior of said knee portion to hold said thigh portion and said knee portion and said shin portion together in flexible connection.

2. A leg guard as claimed in claim 1, further comprising:

a strap on said thigh portion and securable about the leg to hold said thigh portion in place on the anterior surface of the leg.

3. A leg guard as claimed in claim 1, further comprising:

an inner knee pad connected to said first pad of said shin portion and extending to cover the knee of the leg.

4. A leg guard as claimed in claim 3, wherein said inner knee pad is generally cup shaped.

5. A leg guard as claimed in claim 3, wherein said inner knee pad is connected to the first pad by a narrow neck of the first pad.

6. A leg guard as claimed in claim 1, further comprising:

a strap on said knee portion securable about the leg to hold said knee portion in place on the anterior surface of the leg.

7. A leg guard as claimed in claim 1, wherein said connecting strap is a first connection strap, and further comprising:

a second connecting strap having a first end connected to said shin portion and a second end connected to said thigh portion and an intermediate region connected to an interior of said knee portion, said first connecting strap being on one side of a medial line of said leg guard and said second strap being on another side of the medial line.

8. A leg guard as claimed in claim 1, wherein said first end of said connecting strap is connected to said first rigid shell of said shin portion between said first rigid shell and said first pad, and said second end of said connecting strap is connected to said second rigid shell of said thigh portion between said second rigid shell and said second pad, said intermediate region being connected to said third pad of said knee portion and being free of said third rigid shell.

9. A leg guard as claimed in claim 8, wherein said third pad is attached to said third rigid shell of said knee portion by stitching extending about a top and sides of said third rigid portion.

10. A leg guard as claimed in claim 1, wherein said third rigid shell of said knee portion overlaps an outer surface of said first rigid shell of said shin portion in every position assumed by said knee portion as the leg is bent and alternately unbent.

11. A leg guard for attachment to a leg, comprising:

a shin portion having a first rigid shell shaped to fit on an anterior surface of a shin of the leg and a first pad affixed to said first rigid shell between said first rigid shell and the leg;

at least one strap securable about the leg to hold said shin portion in place on the anterior surface of the leg;

a thigh portion having a second rigid shell shaped to fit on an anterior surface of a thigh of the leg and a second pad affixed to said second rigid shell between said second rigid shell and the leg;

a knee portion having a third rigid shell shaped to fit an anterior surface of a knee of the leg and a third pad affixed to said third rigid shell between said third rigid shell and the leg; and a connecting strap having a first end connected to said shin portion and a second end connected to said thigh portion and an intermediate region connected to said knee portion to hold said thigh portion and said knee portion and said shin portion together in flexible connection;

wherein said first end of said connecting strap is connected to said first rigid shell of said shin portion between said first rigid shell and said first pad, and said second end of said connecting strap is connected to said second rigid shell of said thigh portion between said second rigid shell and said second pad, said intermediate region being connected to said third pad of said knee portion and being free of said third rigid shell.

12. A leg guard for attachment to a leg, comprising:

a shin portion having a first rigid shell shaped to fit on an anterior surface of a shin of the leg and a first pad affixed to said first rigid shell between said first rigid shell and the leg;

at least one strap securable about the leg to hold said shin portion in place on the anterior surface of the leg;

a thigh portion having a second rigid shell shaped to fit on an anterior surface of a thigh of the leg and a second pad affixed to said second rigid shell between said second rigid shell and the leg;

a knee portion having a third rigid shell shaped to fit an anterior surface of a knee of the leg and a third pad affixed to said third rigid shell between said third rigid shell and the leg; and a connecting strap having a first end connected to said shin portion and a second end connected to said thigh portion and an intermediate region connected to said knee portion to hold said thigh portion and said knee portion and said shin portion together in flexible connection;

wherein said first end of said connecting strap is connected to said first rigid shell of said shin portion between said first rigid shell and said first pad, and said second end of said connecting strap is connected to said second rigid shell of said thigh portion between said second rigid shell and said second pad, said intermediate region being connected to said third pad of said knee portion and being free of said third rigid shell; and wherein said third pad is attached to said third rigid shell of said knee portion by stitching extending about a top and sides of said third rigid portion.

13. A leg guard for attachment to a leg, comprising: a shin portion having a first rigid shell backed with a first pad; a thigh portion having a second rigid shell backed with a second pad; a knee portion having a third rigid shell backed with a third pad; at least one flexible connecting strap having a first end connected to said shin portion and a second end connected to said thigh portion and an intermediate region connected to a generally central interior point of said knee portion to flexibly join said thigh portion to said shin portion and to position said knee portion therebetween in an externally overlapping manner.

14. A leg guard as claimed in claim 13, further comprising: an inner knee pad extending from said first pad to flexibly reside between said thigh portion and said leg.

* * * * *